US006388380B1

(12) United States Patent
Minami et al.

(10) Patent No.: US 6,388,380 B1
(45) Date of Patent: May 14, 2002

(54) ELECTRIC DISCHARGE LAMP LIGHTING UNIT

(75) Inventors: Fumihiro Minami; Takashi Ohsawa, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/721,960

(22) Filed: Nov. 27, 2000

Related U.S. Application Data

(63) Continuation of application No. PCT/JP99/02020, filed on Apr. 15, 1999.

(51) Int. Cl.[7] ..... H01J 7/44

(52) U.S. Cl. ..... 315/57; 336/213; 336/220; 336/221

(58) Field of Search ..... 315/56, 57, 70, 315/77, 82; 307/10.6, 10.8; 336/15, 213, 220, 221

(56) References Cited

U.S. PATENT DOCUMENTS 6,066,921 A * 5/2000 Nakamura et al. ..... 315/56

6,084,354 A * 7/2000 Kohmura et al. ..... 315/57

FOREIGN PATENT DOCUMENTS

| | | |
|---|---|---|
| JP | 5-198382 | 8/1993 |
| JP | 5-198446 | 8/1993 |
| JP | 7-263157 | 10/1995 |
| JP | 8-298190 | 11/1996 |
| JP | 10-74643 | 3/1998 |
| JP | 10-302537 | 11/1998 |
| JP | 11-54344 | 2/1999 |

* cited by examiner

*Primary Examiner*—Don Wong
*Assistant Examiner*—Thuy Vinh Tran
(74) *Attorney, Agent, or Firm*—Sughrue Mion, PLLC

(57) ABSTRACT

An electric discharge lamp lighting device wherein a high voltage generating transformer 10 comprises a secondary coil 13 wound on an outer side of a laminated core 12 disposed in the center of a bobbin 11 and a primary coil 14 wound on an outer side of said secondary coil 13. A high voltage output terminal 13*a* of said secondary coil 13 is connected to a high voltage terminal of an HID lamp through a terminal 12*a* of a laminated core 12. A low voltage input terminal 13*b* of said secondary coil 13 is connected to a primary coil 14. As a result, insulation volume can be reduced and a reduction in the size of the device can be achieved.

16 Claims, 5 Drawing Sheets

ELECTRIC DISCHARGE LAMP LIGHTING UNIT

CROSS-REFERENCE TO THE RELATED APPLICATION

This Application is a continuation of International Application No. PCT/99/02020, whose International filing date is Apr. 15, 1999 and which was published in Japanese on Oct. 26, 2000, the disclosures of which Application are incorporated by reference herein.

BACKGROUND OF THE INVENTION

1. Field of the Invention

The present invention relates to an electric discharge lamp lighting unit for lighting an electric discharge lamp used as a headlight in a vehicle such as an automobile.

2. Description of the Related Art

The beam strength and lamp efficiency of high intensity discharge lamps (HID) such as metal halide lamps, high-pressure sodium lamps, mercury lamps and the like is very high. In addition, conventionally, the life span of such lamps is high. In view of such advantages, such lamps have been used in indoor applications such as warehouses and factories and in outdoor applications as street lamps. In particular, in recent years, such lamps have been used as vehicle headlights in automobiles and the like. Since it is necessary to apply a high voltage starting voltage in order to light such lamps, it is necessary to provide an igniter which generates a starting voltage and add a ballast in order to light the discharge lamp in a stable manner.

FIG. 1 is a cross section of the interior structure of a high voltage generating transformer used in a conventional discharge lamp. In the figure, reference numeral 1 denotes a high voltage-generating transformer. The high voltage generating transformer 1 is schematically shown as comprising a columnar core 2 disposed in the center of the transformer, a primary coil 3 wound on the periphery of the core 2, a secondary coil 4 wound on the outer side of the primary coil 3 and an insulating member 5 which insulates between the primary and secondary coils 3, 4.

Since the high voltage generating transformer 1 in the conventional discharge lamp is constructed as above, the secondary coil 4 which acts as a high voltage generating section is near the low voltage core 2 and the periphery of the low voltage core 2. As a result, it is necessary to create an insulating distance L with respect to high voltage between the core 2 and the secondary coil 4 and between the secondary coil 4 and its peripheral components. Therefore the insulating member 5 must be of a minimum thickness. As a result, the problem of reducing the size of a lamp which is to be mounted in an automobile for example has arisen.

SUMMARY OF THE INVENTION

The present invention is proposed to solve the above problems and has the object of providing a small sized electric discharge lamp lighting device which can generate a high voltage.

The electric discharge lamp lighting device of the present invention disposes a secondary coil for the high voltage generating transformer on the core side and a primary coil on the outer side of the secondary coil. A high voltage terminal for the secondary coil is connected to a terminal of the core and a low voltage terminal of the secondary coil is connected to the primary coil. In such a way, it is possible to reduce the insulating volume and the number of components as well as reduce the size of the unit.

The electric discharge lamp lighting device of the present invention achieves a reduction in the size of the electric discharge lamp lighting device by reducing the size of the high voltage generating transformer as a result of integrating the bobbin of the high voltage generating transformer with the connector used to connect the discharge lamp.

The electric discharge lamp lighting device of the present invention facilitates insulation by maintaining the distance of the peripheral members in order to concentrate the secondary coil, which generates a high voltage, in the center of the high voltage generating transformer by providing the high voltage generating transformer on the axis of the high voltage terminal of the discharge lamp.

The electric discharge lamp lighting device of the present invention achieves a reduction in the size of the electric discharge lamp lighting device by reducing the size of the high voltage transformer by integration of the holder which holds the core of the high voltage transformer with the terminal of the core.

The electric discharge lamp lighting device of the present invention achieves reductions in costs and the size of the mold by the provision of a partition which fixes only the high voltage generating transformer in the case into which the high voltage generating transformer is embedded.

The electric discharge lamp lighting device of the present invention simplifies and increases the assembly speed of the electrical connection of the high voltage transformer and the wiring board by projecting a terminal connected to a terminal of a wiring board in the case into the high voltage generating transformer when housing the high voltage generating transformer in the case.

The electric discharge lamp lighting device of the present invention realizes a compact size for the electric discharge lamp lighting device through the creation of an empty space by offsetting the case housing the high voltage generating transformer to one side of the axis of the connector of the high voltage generating transformer and providing a luminous intensity switching motor in the space.

DETAILED DESCRIPTION OF THE PREFERRED EMBODIMENTS

In order to explain the invention in greater detail the preferred embodiments are outlined below with reference to the accompanying figures.

Embodiment 1

Figure 1:
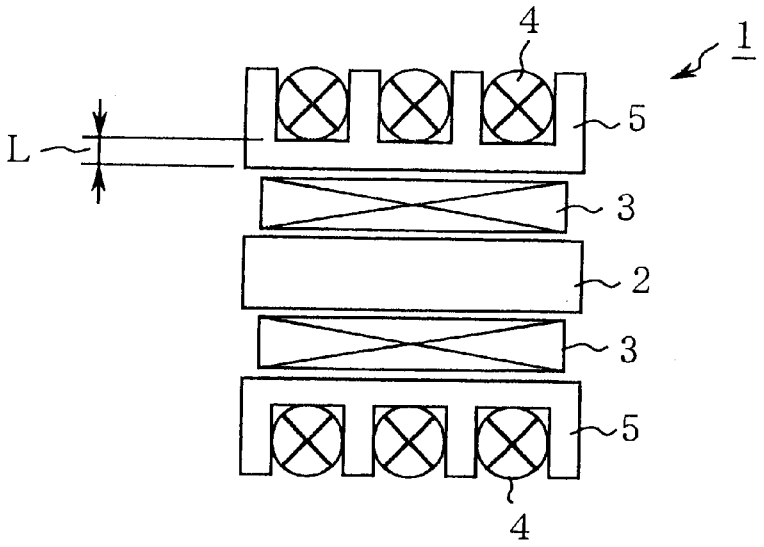
FIG.1 (PRIOR ART)
FIG. 1 is a cross section of the internal structure of a high voltage generating transformer in a conventional electric discharge lamp lighting device.
Figure 2:
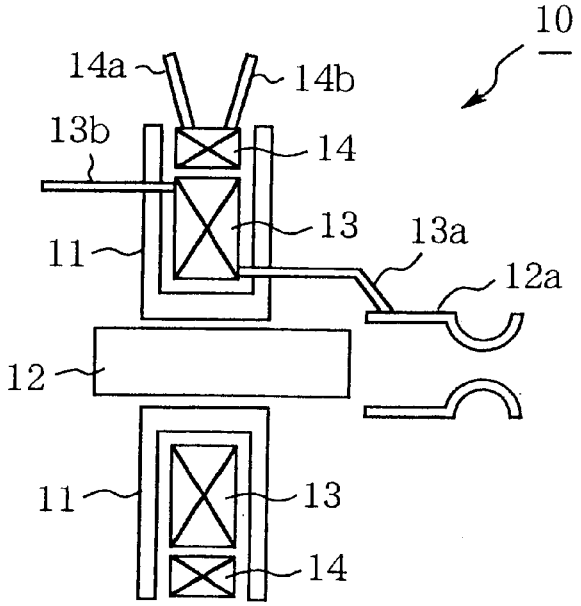
FIG. 2 is a cross section of main components in the internal structure of a high voltage generating transformer in a electric discharge lamp lighting device according to a first embodiment of the present invention.

FIG. 2 is a cross sectional view of the main internal components of a high voltage generating transformer used in an electric discharge lamp lighting device. In FIG. 2, reference numeral 10 denotes a high voltage-generating transformer. In the high voltage generating transformer 10, a secondary coil 13 is wound on the outer side of a laminated core 12 disposed in the center of a bobbin 11. A primary coil 14 is wound on the outer side of the secondary coil 13. The high voltage output terminal 13*a* of the secondary coil 13 is connected to the terminal 12*a* of the laminated core 12. The low voltage input terminal 13*b* of the secondary coil 13 is connected to the output terminal 14*a* of the primary coil 14. Both terminals are equipotential. A conductive material mainly composed of copper or aluminum for example may be used for each coil 13, 14. Furthermore an insulating material such as kraft paper, synthetic resin enamel (polyvinyl formal) or the like may be used as the insulator between the coils 13, 14 and for insulation in each coil 13, 14. A magnetic material composed of silicon steel or the like may be used as the laminated core 12.

On the basis of the above construction, the secondary coil 13 is disposed on the inner side of the primary coil 14 in contradistinction to the conventional example. As a result, it is possible to use the output terminal 13*a* of the secondary coil 13 as a terminal for the center of the laminated core 12. Thus mounting operations are simplified, insulating volume and number of components are reduced and the size of the device can be reduced. Furthermore the distance separating the peripheral members can be maintained and insulation simplified as the secondary coil 13 which generates a high voltage is concentrated in the center of the high voltage-generating transformer 10.

Figure 3:
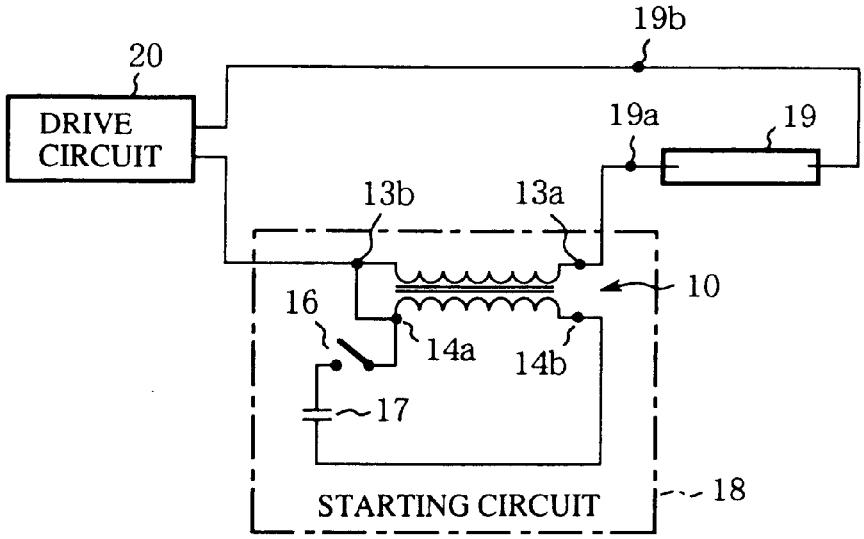
FIG. 3 is a circuit diagram of the structure of a electric discharge lamp lighting device containing the high voltage generating transformer shown in FIG. 2.

FIG. 3 is a circuit diagram of the layout of a lamp lighting device containing a high voltage generating transformer 10 as shown in FIG. 2. In FIG. 3, reference numeral 16 denotes a switch, 17 is a capacitor. The switch 16, the capacitor 17 and high voltage generating transformer 10 form a starting circuit 18 which acts as a lighting device. In FIG. 3, 19 is an HID lamp. 20 is a drive circuit containing a drive power source (not shown) of the HID lamp 19. The output terminal 13*a* of the secondary coil 13 of the high voltage generating transformer 10 is connected to the high voltage terminal 19*a* of the HID lamp 19 through a terminal 12*a* of the laminated core 12.

According to the first embodiment, it is possible to apply a high voltage (secondary voltage) on the HID lamp 19 from the secondary coil 13 by magnetic induction in the same way as the conventional example through the use of a compact high voltage generating transformer 10. As a result, it is possible to achieve a compact lighting device to light a discharge lamp such as an HID lamp 19.

Figure 4:
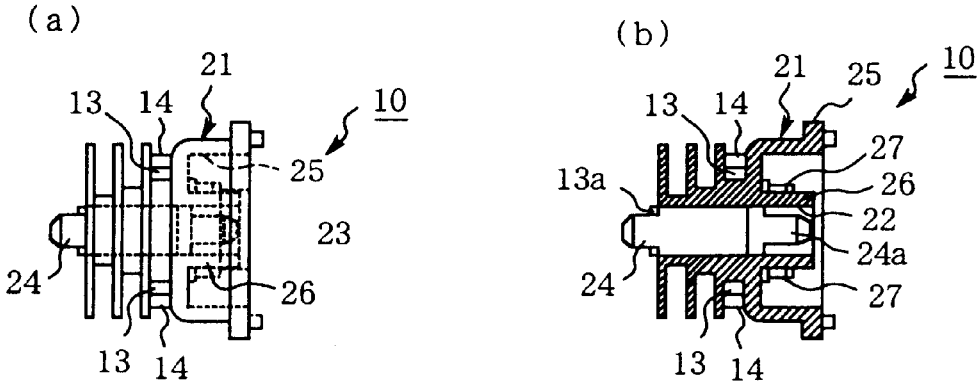
FIG. 4(*a*) and FIG. 4(*b*) show the structure of a high voltage generating transformer used in a electric discharge lamp lighting device according to a first embodiment of the present invention where (a) is a front view and (b) is a cross sectional view.

Since FIG. 4(*a*) and FIG. 4(*b*) show the structure of a high voltage generating transformer 10 used in a lighting device according to a first embodiment of the present invention. FIG. 4(*a*) is a plan view and FIG. 4(*b*) is a cross sectional view. In the figures, 21 is a bobbin. Secondary and primary coil 13, 14 are provided on an outer side of the bobbin 21. A laminated core 12 is inserted into the center of the coils and a through hole 22, which is rectangular in cross section, is provided to hold the core in place. A connector 23 is integrally provided in the bottom section of the bobbin 21 (right side of the figure) to house the lamp which will be discussed below. In other words, high voltage generating transformer 10 according to a first embodiment is in the simple form of a bobbin 21 and a connector 23.

Figure 5:
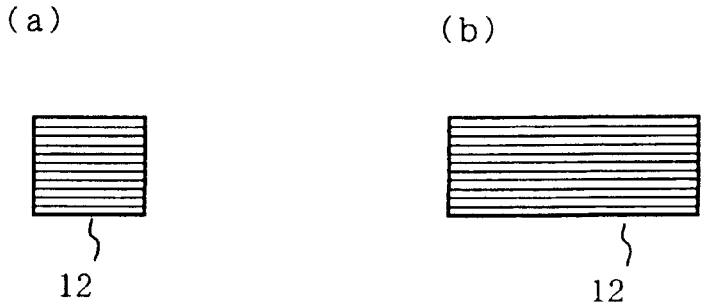
FIG. 5(*a*) and 5(*b*) show an actual example of a core where (a) is a front view and (b) is a cross sectional view.
Figure 6:
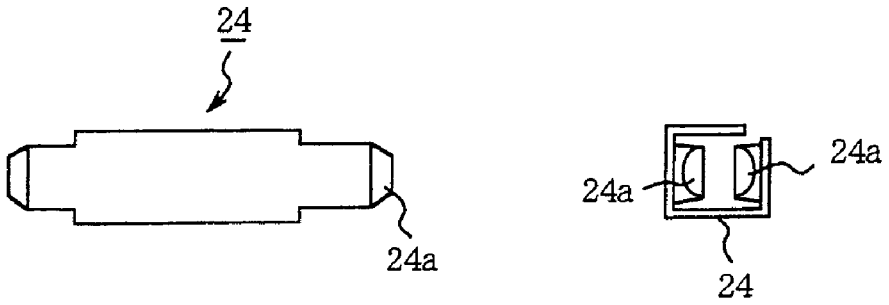
FIG. 6(*a*) and 6(*b*) show a terminal also acting as a holder containing the core where (a) is a front view and (b) is a lateral view.

The laminated core 12 according to the first embodiment is a laminated core in a rectangular parallelopiped shape as shown in FIG. 5(*a*) and FIG. 5(*b*) formed from a magnetic material as discussed above. The core 12 is housed in a hollow metallic holder 24 which is rectangular in cross section as shown in FIG. 6(*a*) and FIG. 6(*b*). A pair of terminals 24*a*, 24*a* are provided on one end of the metallic holder 24 (right side of the figure) to connect the high voltage terminal (not shown) of the discharge lamp. The other end is closed in order to hold the laminated core 12. The metallic holder 24 according to the first embodiment separates a rectangular metallic plate such as that shown in FIG. 6(*b*) into roughly equal intervals in a direction which intersects with the longitudinal direction of the metallic holder 24 and which bends the metallic plate at approximately 90° by three folds at three tubular sections along the longitudinal direction.

The connector 23 in the first embodiment is comprised of an outer tubular section 25 which contains the tip of the base 29 of the HID lamp 19 and an inner tubular section 26 which is disposed on the center of the outer tubular section 25 and which contains the high voltage terminal (not shown) of the HID lamp 19. A bush 27 for preventing electric discharge is mounted on the outer peripheral surface of the inner tubular section 26.

Figure 7:
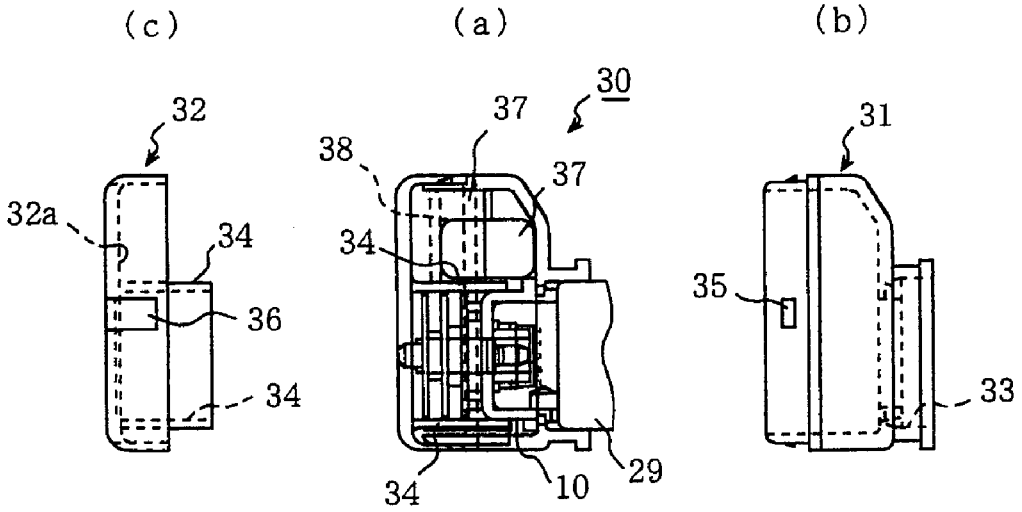
FIG. 7(*a*) is a cross sectional view of a high voltage generating transformer contained in a case where FIG. 7(*b*) is a front view of a first case section of the case shown in FIG. 7(*a*) and FIG. 7(*c*) is a front view of a second case section.

The high voltage-generating transformer 10 comprised as shown above is contained in a molded state in the case 30 as shown in FIG. 7(*a*). The case 30 may be disassembled into a first case 31 and a second case 32 as shown in FIG. 7(*b*) and FIG. 7(*c*). A container hole 33 is formed in a section of the first case 31 in order to act as a socket which contains the base 29 of the HID lamp 19. A partition 34 for separating the high voltage-generating transformer 10 and the wiring board which will be discussed below is provided on an inner section of the second case 32 in an offset position. Furthermore an engagement indentation 35 is provided on an outer peripheral section of the first case 31. An engaging hook 36 which engages with the engaging indentation 35 is provided on the outer periphery of the second case 32.

The high voltage-generating transformer 10 is contained in the indented section which is fixed by the partition 34 of the second case 32. Thereafter it is fixed by resin molding and a wiring board 38 which mounts various electronic components 37 is housed in the bottom section 32*a* of the second case 32 on the outer side of the partition 34.

Figure 8:
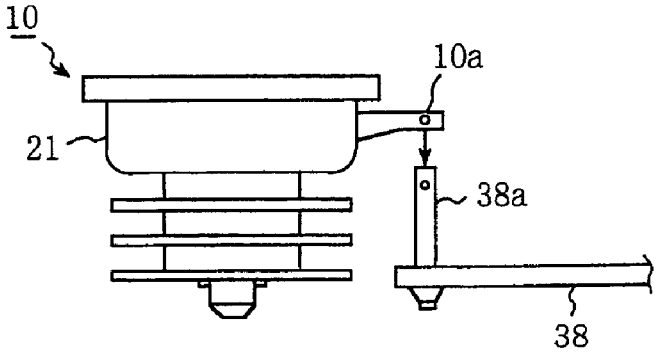
FIG. 8 is a front view of an example of a method of electrically connecting a high voltage generating transformer and a wiring board.

In relation to the electrical connection of the high voltage generating transformer 10 and the wiring board 38, as shown by FIG. 8 after housing the wiring board 38 in the second case 32, it is possible to connect the terminal 10*a* on the high voltage generating transformer 10 side to the terminal 38*a* on the wiring board side 38. In this way, it is possible to perform connection operations in a rapid and simple manner by connecting both terminals in a predetermined position and form.

Figure 9:
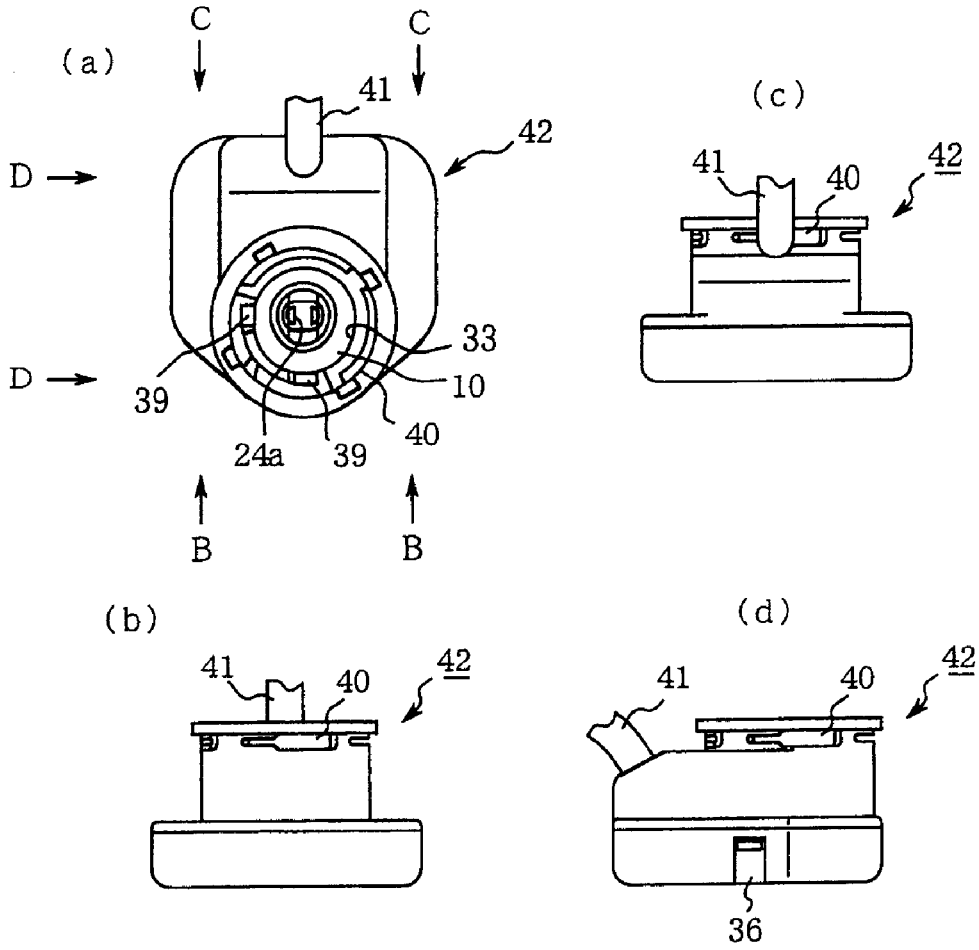
FIG. 9(*a*) to FIG. 9(*d*) show the outer appearance of a lamp lighting device where (*a*) is a front view, (*b*) is a perspective view along the line BB of FIG. 9(*a*), (*c*) is a perspective view along the line CC of FIG. 9(*a*) and (*d*) is a perspective along the line DD of FIG. 9(*a*).

The terminal 19*b* on the low voltage side of the HID lamp 19 is formed as a ring electrode (not shown) on the lower outer peripheral face of the base 29 of the HID lamp 19. On the other hand, a terminal (not shown) on the low voltage side of the high voltage-generating transformer 10 is gripped in a stable manner between the outer peripheral face of the outer tubular section 25 of the bobbin 21 and the inner peripheral face of the container hole 33 of the first case section 31. One section of the terminal is exposed on the inner peripheral face of the container hole 33 as shown in FIG. 9(*a*). The electrical connection of the terminal 19*b* on the low voltage side of the HID lamp 19 which is formed as a ring electrode and the terminal on the low voltage side of the high voltage generating transformer 10 is achieved by housing the base 29 of the HID lamp 19 in the container hole 33 which acts as a socket. Furthermore as shown in FIG. 9(*a*) and FIG. 9(*d*), 40 is an engaging hole which is formed on the upper section of the container hole 33 acting as a socket and which engages with an engaging projection (not shown) formed on the outer periphery of the base 29 of the HID lamp 19. 41 is a power cable for supplying electric power to the electronic components 37 housed in the case 30. 42 is a lighting device which contains the high voltage generating transformer 10 in the case 30 and which can house the HID lamp 19.

It is possible to reduce the size of the device in the first embodiment by integrating the bobbin 21 and the connector 23. In the first embodiment, a laminated core 12 is used in order to further reduce the size of the device. However it is also possible to increase the magnetic flux density and reduce eddy currents by the use of such a laminated core. Furthermore in embodiment 1, since resin molding is only performed in the indentation secured by the partition 34, it is possible to reduce the amount. of molding and thus reduce costs in comparison with the situation in which resin molding is performed in the second case 32.

Figure 10:
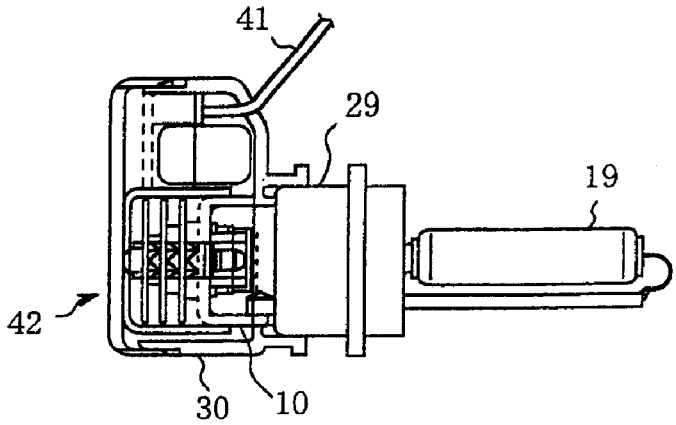
FIG. 10 is a front view of a partial cross section showing an HID lamp as housed in a lamp lighting device according to a first embodiment of the present invention.

The high voltage generating transformer 10 according to a first embodiment comprises a section of the starter circuit 18 as shown in FIG. 3. The starter circuit 18 and the drive circuit 20 comprise a lighting device 42 which houses the HID lamp 19 as shown in FIG. 10. Also according to the first embodiment, it is possible to reduce the size of the lighting device 42 itself by using the small sized high voltage generating transformer 10.

Figure 11:
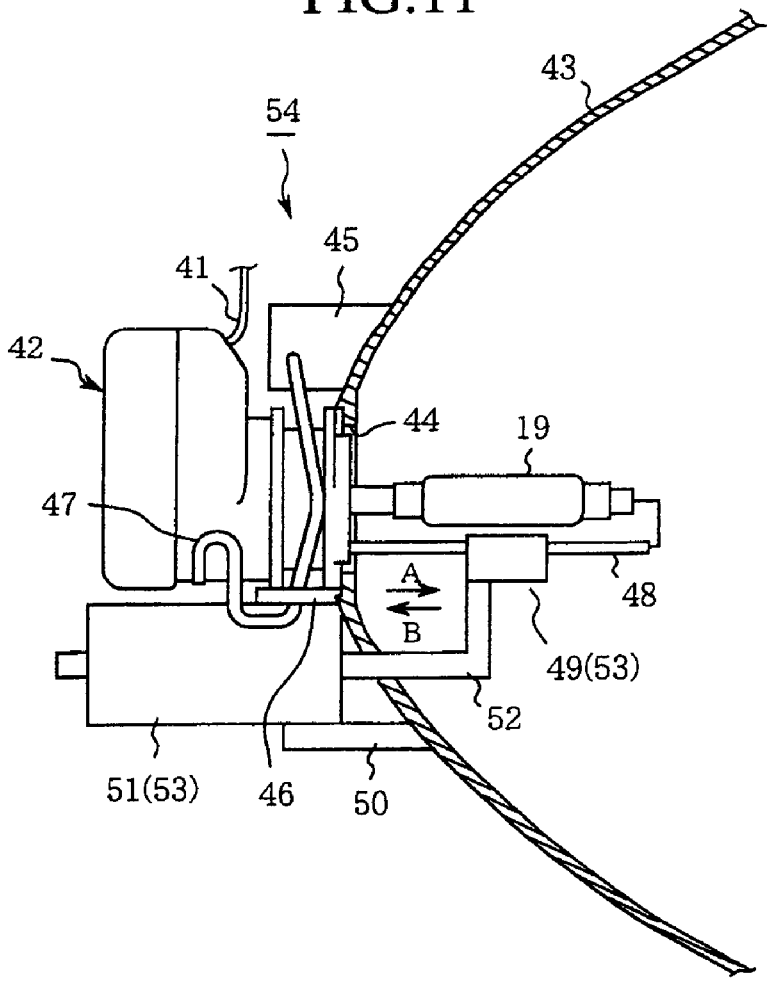
FIG. 11 is a front view of a partial cross section showing a discharge lamp device as used in a lamp lighting device according to a first embodiment of the present invention.
Figure 12:
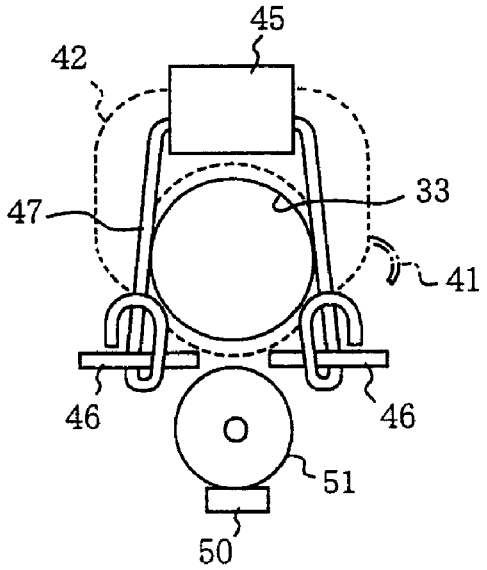
FIG. 12 is a lateral view of the mounting structure of a lighting device for an electric discharge lamp lighting device shown in FIG. 11.

In FIG. 11 and FIG. 12, 43 is a reflecting mirror with a three dimensional parabolic shape. An aperture 44 is provided on the bottom of the reflecting mirror 43. A lighting device 42 which houses an HID lamp 19 as shown in FIG. 10 is housed in an aperture 44. The lighting device 42 is gripped by a compressing spring 47 which is fixed by a first supporting member 45 and a second supporting member 46 which are fixed to a rear face in proximity to the bottom of the reflecting mirror 43. A shade 49 which switches luminous intensity and which is retractable in the longitudinal direction of the HID lamp 19 (the direction of the arrow A and B in FIG. 11) is mounted on a lower section of the HID lamp 19 as a guide for the low voltage wiring sheath 48. The displacement of the shade 49 which switches luminous intensity is performed by the luminous intensity switching motor 51 which is mounted on the support member 50 fixed to the rear face in proximity to the bottom of the reflecting mirror 43. The switching motor 51 advances or retracts an arm 52 which is fixed to one end of the shade 49 in order to switch luminous intensity. The shade 49 for switching the luminous intensity and the luminous intensity switching motor 51 comprise a luminous intensity switching mechanism 53. The shade 49 for switching the luminous intensity when advancing reduces the amount of light which enters the upper forward section by filtering a section of downward light out of the light which approaches the inner face of the reflecting mirror 43 from the HID lamp 19. The position of the shade 49 for switching the luminous intensity in FIG. 11 is in a low beam state (L beam) in which the amount of light is reduced. It is possible to create a high beam state (H beam) in which the amount of light is restored by retracting the shade 49 for switching the luminous intensity to a position proximate to the bottom of the reflecting mirror 43.

In embodiment 1, the mechanism 53 for switching luminous intensity, the HID lamp 19, the lighting device 42 and the reflecting mirror 43 comprise an electric discharge lamp device 54.

In embodiment 1, as shown in FIG. 11 and FIG. 12, a lighting device 42 is offset to an upper position with reference to the center of the bottom of the reflecting mirror 43 or the axial line of the high voltage terminal of the HID lamp 19. Due to the offset, it is possible to create an empty space in the lower bottom of the reflecting mirror 43. Since it is possible to use the empty space as a mount for the luminous intensity switching motor 51, it is possible to increase the compactness of the discharge lamp device 54. In order to achieve the offset, the position of the high voltage generating transformer 10 is offset to one side in the case 30 of the lighting device 42 in consideration of the fact that the high voltage generating transformer 10 is disposed on the axial line of the high voltage terminal of the HID lamp 19. The section which generates high voltage is concentrated on the axial line by the disposition of the high voltage-generating transformer 10 on the axial line of the high voltage terminal of the HID lamp 19. Thus insulation with respect to other components is easy due to the concentration of the section which generates high voltage on the axial line.

As explained above, according to the present invention, a secondary coil of the high voltage generating transformer is disposed on the core side. A primary coil is disposed on the outer side of the secondary coil and the output terminal of the secondary coil is connected to the terminal of the core. The input terminal of the secondary coil is connected to the output terminal of the primary coil. In this way, it is possible to reduce the volume of the insulation volume and reduce the number of components and therefore reduce the size of the device.

According to the present invention, the high voltage generating transformer bobbin and the discharge lamp connecting connector are integrated. Otherwise the holder which grips the core of the high voltage generating transformer and the terminal of the core are integrated. Thus it is possible to reduce the size of the discharge lamp lighting device through the reduction in size of the high voltage generating transformer.

According to the present invention, since the high voltage generating transformer is provided on the axial line of the high voltage terminal of the discharge lamp, a distance with respect to peripheral components may be maintained and insulation may thus be easily ensured as the secondary coil which generates high voltage is concentrated in the-central section of the high voltage generating transformer.

According to the present invention, since the partition is provided which secures the high voltage generating transformer to the case in which the transformer is embedded, it is possible to reduce the amount of molding and thus reduce costs.

According to the present invention, since the terminal which is connected with the terminal of the wiring board in the case projects onto the high voltage generating transformer when stored in the case, the electrical connection operation of the high voltage generating transformer and the wiring board may be simplified and performed in a shorter time.

According to the present invention, an empty space is formed by offsetting a case which stores the high voltage generating transformer to one side of an axial line of a connector for the discharge lamp and a luminous intensity switching motor is disposed in the space. In this way, it is possible to increase the compactness of the discharge lamp device.

As shown above, an electric discharge lamp device according to the present invention is adapted to light an electric discharge lamp used as a headlight of the vehicle such as an automobile.

What is claimed is:

1. An electric discharge lamp lighting device provided with a high voltage generating transformer, wherein a secondary coil of said high voltage generating transformer is disposed near a core, a primary coil is disposed on an outer side of said secondary coil, a high voltage terminal of said secondary coil is connected to a terminal of said core and a low voltage terminal of said secondary coil is connected to said primary coil.

2. An electric discharge lamp lighting device according to claim 1, wherein a bobbin of said high voltage generating transformer and a connector for connecting an electric discharge lamp are integrated.

3. An electric discharge lamp lighting device according to claim 2, wherein a partition securing only said high voltage generating transformer in a case in which said high voltage generating transformer is embedded is provided.

4. An electric discharge lamp lighting device according to claim 3, wherein when storing said high voltage generating transformer in a case, a terminal connected with a terminal of a wiring board in said case projects to said high voltage generating transformer.

5. An electric discharge lamp lighting device according to claim 1, wherein said high voltage generating transformer is provided on an axial line of a high voltage terminal of a discharge lamp.

6. An electric discharge lamp lighting device according to claim 1, wherein a holder gripping said core of said high voltage generating transformer and said terminal of said core are integrated.

7. An electric discharge lamp lighting device according to claim 1, wherein an empty space is formed by offsetting a case storing said high voltage generating transformer to one side of an axial line of a connector connecting a discharge lamp, said space housing a luminance intensity switching motor.

8. An electric discharge lamp lighting device provided with a high voltage generating transformer, said high voltage generating transformer having a core made of a magnetic material, a primary coil encircling said core, a secondary coil encircling said core, a high voltage terminal of said secondary coil connected to a terminal of said core and a low voltage terminal of said secondary coil connected to a terminal of said primary coil, and wherein said secondary coil supplies a secondary voltage generated by magnetic induction of said high voltage generating transformer.

9. An electric discharge lamp lighting device according to claim 8, wherein said primary coil encircles said secondary coil.

10. An electric discharge lamp lighting device according to claim 8, wherein said electric discharge lamp lighting device includes an connector for connecting an electric discharge lamp and said core extends along an axis of said connector.

11. An electric discharge lamp lighting device according to claim 8, wherein an empty space is formed by offsetting a case storing said high voltage generating transformer to one side of an axis of a connector connecting said discharge lamp, said space housing a luminance intensity switching motor.

12. An electric discharge lamp lighting device according to claim 8, wherein a bobbin of said high voltage generating transformer and a connector for connecting an electric discharge lamp are integrated together.

13. An electric discharge lamp lighting device according to claim 8, wherein a connector for connecting an electric discharge lamp is integrally provided in an end section of a bobbin of said high voltage generating transformer.

14. An electric discharge lamp lighting device comprising:

a connector connecting a discharge lamp, a high voltage generating transformer supplying voltage to said discharge lamp, a case storing said high voltage generating transformer, a luminance intensity switching motor for switching luminance intensity, and wherein an empty space is formed by offsetting said case to one side of an axis of said connector and said space houses said luminance intensity switching motor.

15. An electric discharge lamp lighting device provided with a high voltage generating transformer, wherein a secondary coil of said high voltage generating transformer is disposed near a core, a primary coil encircling said secondary coil, a high voltage terminal of said secondary coil being connected to a terminal of said core and a low voltage terminal of said secondary coil being connected to said primary coil.

16. An electric discharge lamp lighting device provided with a high voltage generating transformer, wherein a secondary coil of said high voltage generating transformer is disposed near a core, a primary coil circumferentially surrounds said secondary coil, a high voltage terminal of said secondary coil being connected to a terminal of said core and a low voltage terminal of said secondary coil being connected to said primary coil.

* * * * *